US007736486B2

(12) United States Patent
Stevens et al.

(10) Patent No.: US 7,736,486 B2
(45) **Date of Patent: *Jun. 15, 2010**

(54) SYSTEM AND METHOD FOR PRODUCING COPPER POWER BY ELECTROWINNING IN A FLOW-THROUGH ELECTROWINNING CELL

(75) Inventors: Antonioni C Stevens, Thatcher, AZ (US); Stanley R Gilbert, Thatcher, AZ (US); Scot P Sandoval, Morenci, AZ (US); Timothy G Robinson, Scottsdale, AZ (US); John O Marsden, Phoenix, AZ (US)

(73) Assignee: Freeport-McMoran Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/126,559

(22) Filed: May 23, 2008

(65) Prior Publication Data

US 2008/0217185 A1 Sep. 11, 2008

Related U.S. Application Data

(63) Continuation of application No. 11/160,911, filed on Jul. 14, 2005, now Pat. No. 7,378,010.

(60) Provisional application No. 60/590,883, filed on Jul. 22, 2004, provisional application No. 60/590,882, filed on Jul. 22, 2004.

(51) Int. Cl.
*C25C 1/12* (2006.01)

(52) U.S. Cl. ..... 205/576; 205/574; 205/575; 205/580; 205/584

(58) Field of Classification Search ..... 205/572, 205/574, 575, 576, 580, 584
See application file for complete search history.

(56) References Cited

U.S. PATENT DOCUMENTS

| | | | | |
|---|---|---|---|---|
| 7,368,049 | B2 * | 5/2008 | Sandoval et al. | 205/576 |
| 7,378,010 | B2 * | 5/2008 | Stevens et al. | 205/574 |
| 7,378,011 | B2 * | 5/2008 | Sandoval et al. | 205/576 |
| 7,452,455 | B2 * | 11/2008 | Sandoval et al. | 205/579 |
| 7,494,580 | B2 * | 2/2009 | Sandoval et al. | 205/576 |
| 2006/0021880 | A1 * | 2/2006 | Sandoval et al. | 205/576 |
| 2008/0105556 | A1 * | 5/2008 | Sandoval et al. | 205/148 |

* cited by examiner

*Primary Examiner*—Bruce F Bell
(74) *Attorney, Agent, or Firm*—Snell & Wilmer L.L.P.

(57) ABSTRACT

This invention relates to a system and method for producing a metal powder product using conventional electrowinning chemistry (i.e., oxygen evolution at an anode) in a flow-through electrowinning cell. The present invention enables the production of high quality metal powders, including copper powder, from metal-containing solutions using conventional electrowinning processes and/or direct electrowinning.

18 Claims, 2 Drawing Sheets

Figure 1:
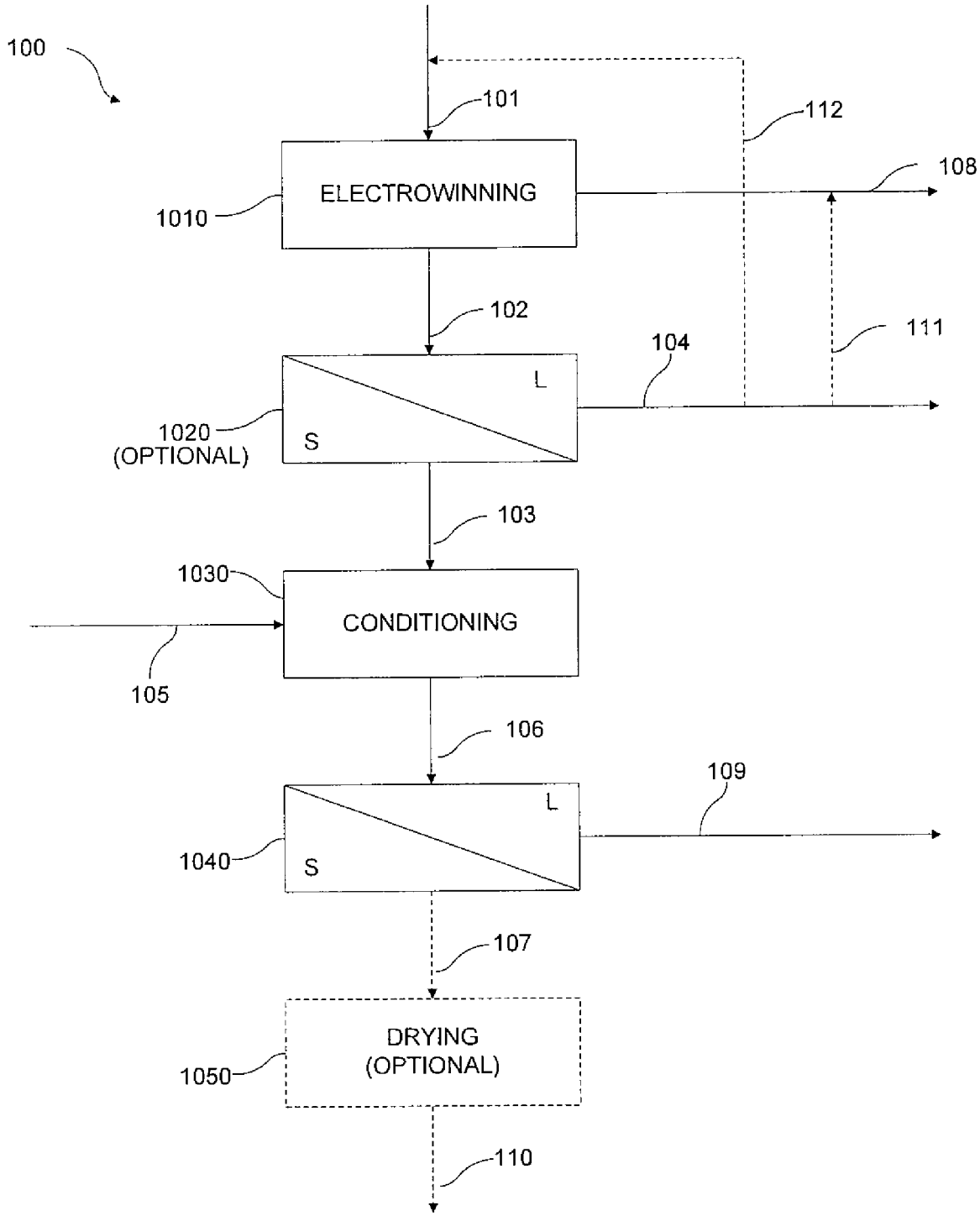

SYSTEM AND METHOD FOR PRODUCING COPPER POWER BY ELECTROWINNING IN A FLOW-THROUGH ELECTROWINNING CELL

CROSS REFERENCE TO RELATED APPLICATIONS

This application is a continuation of and claims priority to U.S. application Ser. No. 11/160,911, entitled "System and Method for Producing Copper Powder by Electrowinning in a Flow-Through Electrowinning Cell," which was filed on Jul. 14, 2005, and which claims priority to U.S. Provisional Application Ser. No. 60/590,882, filed Jul. 22, 2004, and U.S. Provisional Application Ser. No. 60/590,883, also filed Jul. 22, 2004. All of the above-referenced applications are hereby incorporated by reference herein in their entirety.

FIELD OF INVENTION

This invention relates to a system and method for producing metal powder using electrowinning. In particular, this invention relates to a system and method for producing a copper powder product using conventional electrowinning chemistry in a flow-through electrowinning cell.

BACKGROUND OF THE INVENTION

Conventional copper electrowinning processes produce copper cathode sheets. Copper powder, however, is an alternative to solid copper cathode sheets. Production of copper powder as compared to copper cathode sheets can be advantageous in a number of ways. For example, it is potentially easier to remove and handle copper powder from an electrowinning cell, as opposed to handling relatively heavy and bulky copper cathode sheets. In traditional electrowinning operations yielding copper cathode sheets, harvesting typically occurs every five to eight days, depending upon the operating parameters of the electrowinning apparatus. Copper powder production has the potential, however, of being a continuous or semi-continuous process, so harvesting may be performed on a substantially continuous basis, therefore reducing the amount of "work-in-process" inventory as compared to conventional copper cathode production facilities. Also, there is potential for operating copper electrowinning processes at higher current densities when producing copper powder than with conventional electrowinning processes that produce copper cathode sheets, capital costs for the electrowinning cell equipment may be less on a per unit of production basis, and it also may be possible to lower operating costs with such processes. It is also possible to electrowin copper effectively from solutions containing lower concentrations of copper than using conventional electrowinning at acceptable efficiencies. Moreover, copper powder exhibits superior melting characteristics over copper cathode sheets and copper powder may be used in a wider variety of products and applications than can conventional copper cathode sheets. For example, it may be possible to directly form rods, shapes, and other copper and copper alloy products from copper powder. Copper powder can also be melted directly or briquetted prior to melting and conventional rod production.

SUMMARY OF THE INVENTION

In accordance with various embodiments of the present invention, copper powder may be produced and harvested using conventional electrowinning chemistry (i.e., oxygen evolution at the anode) and/or direct electrowinning (i.e., electrowinning copper from copper-containing solution without the use of solvent extraction techniques).

While the way in which the present invention addresses the deficiencies and disadvantages of the prior art is described in greater detail hereinbelow, in general, according to various aspects of the present invention, a process for producing copper powder includes the steps of (i) electrowinning copper powder from a copper-containing solution to produce a slurry stream containing copper powder particles and electrolyte; (ii) optionally, separating at least a portion of the electrolyte from the copper powder particles in the slurry stream; (iii) optionally, conditioning the slurry stream to adjust the pH level of the stream; (iv) optionally, stabilizing at least a portion of the copper powder particles; (v) removing the bulk of the liquid from the copper powder particles; and (vi) optionally, drying the copper powder particles originally present in the slurry stream to produce a final copper powder product.

In accordance with another exemplary embodiment of the invention, a process for producing copper powder includes the steps of (i) electrowinning copper powder from a copper-containing solution to produce a slurry stream containing copper powder particles and electrolyte; (ii) optionally, separating at least a portion of the electrolyte from the copper powder particles in the slurry stream; (iii) optionally, separating one or more coarse copper powder particle size distributions in the slurry stream from one or more finer copper powder particle size distributions in the slurry stream in one or more size classification stages; (iv) optionally, conditioning the slurry stream to adjust the pH level of the stream and/or to stabilize the copper powder particles; (v) removing the bulk of the liquid from the copper powder particles; (vi) optionally, drying the copper powder particles originally present in the slurry stream to produce a dry copper powder stream; (vii) optionally, separating one or more coarse copper powder particle size distributions in the dry copper powder stream from one or more finer copper powder particle size distributions in the dry copper powder stream in one or more size classification stages; and (viii) either collecting the copper powder final product from the process or subjecting the copper powder stream to further processing.

In accordance with various aspects of the present invention, the process and apparatus for electrowinning copper powder from a copper-containing solution are configured to optimize copper powder particle size and/or size distribution, to optimize cell operating voltage, cell current density, and overall power requirements, to maximize the ease of harvesting copper powder from the cathode, and/or to optimize copper concentration in the lean electrolyte stream leaving the electrowinning operation.

In accordance with other aspects of the invention, process stages and operating parameters are designed to optimize copper powder quality, particularly with regard to the level of surface oxidation of the copper powder particles, and, optionally, the particle size distribution and physical properties of the final copper powder product(s). Moreover, as a general premise, various embodiments of the present invention preferably decrease the number of required processing steps between introduction of a copper-containing solution and providing one or more final, saleable copper powder products to optimize economic efficiency. Additionally, various aspects of the present invention enable enhancements in process ergonomics and process safety while achieving improved process economics.

These and other advantages of a process according to various aspects and embodiments of the present invention will be apparent to those skilled in the art upon reading and understanding the following detailed description with reference to the accompanying figures.

BRIEF DESCRIPTION OF THE DRAWING FIGURES

Figure 2:
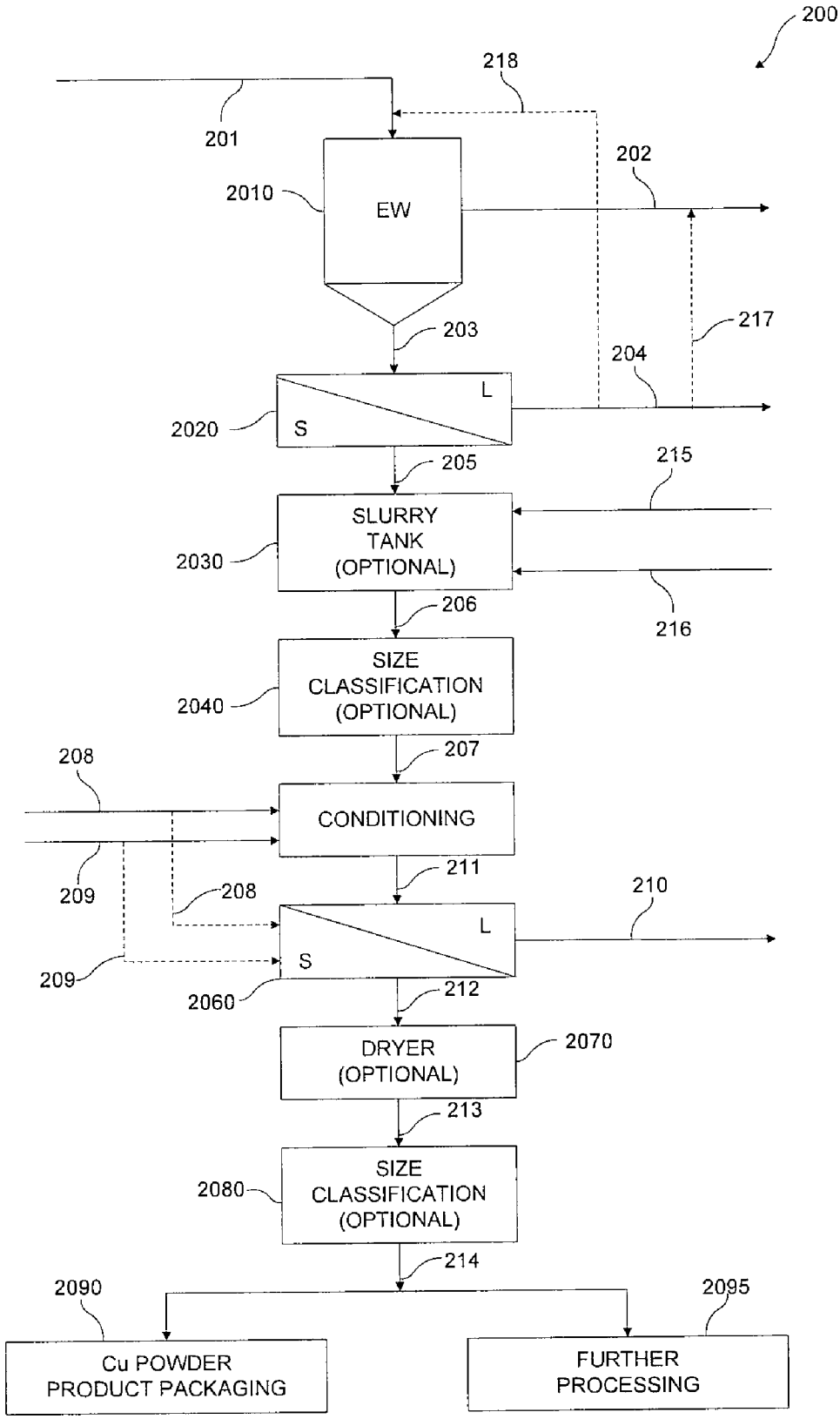

The subject matter of the present invention is particularly pointed out and distinctly claimed in the concluding portion of the specification. A more complete understanding of the present invention, however, may best be obtained by referring to the detailed description and claims when considered in connection with the drawing figures, wherein like numerals denote like elements and wherein:

FIG. 1 is a flow diagram illustrating various aspects of a process for producing copper powder in accordance with one exemplary embodiment of the present invention; and FIG. 2 is a flow diagram illustrating various aspects of a process for producing copper powder in accordance with another exemplary embodiment of the present invention.

DETAILED DESCRIPTION OF THE INVENTION

The present invention exhibits significant advancements over prior art processes, particularly with regard to product quality and process efficiency. Moreover, existing copper recovery processes that utilize conventional electrowinning processes may, in many instances, be retrofitted to exploit the many commercial benefits the present invention provides.

In general, according to various aspects of the present invention, a process for producing copper powder includes the steps of: (i) electrowinning copper powder from a copper-containing solution to produce a slurry stream containing copper powder particles and electrolyte; (ii) optionally, separating at least a portion of the electrolyte from the copper powder particles in the slurry stream; (iii) conditioning the slurry stream; (iv) optionally, separating the bulk of the liquid from the copper powder particles; and (v) optionally, drying the copper powder particles originally present in the slurry stream to produce a final, stable copper powder product.

With initial reference to FIG. 1, copper powder process 100 comprises an electrowinning stage 1010 in which copper powder is electrowon from a copper-containing solution 101 to produce a copper powder slurry stream 102.

As an initial matter, it should be understood that various embodiments of the present invention may be successfully employed to produce high quality copper powder from copper-containing solutions using conventional electrowinning chemistry (i.e., oxygen evolution at the anode) following the use of solvent extraction and/or other methods for concentration of copper in solution, such as ion exchange, ion selective membrane technology, solution recirculation, evaporation, and other methods, direct electrowinning (i.e., electrowinning copper from copper-containing solution without the use of solvent extraction techniques or without the use of other methods for concentration of copper in solution, such as ion exchange, ion selective membrane technology, solution recirculation, evaporation, and other methods), and alternative anode reaction electrowinning chemistry (i.e., oxidation of ferrous ion to ferric ion at the anode). Conventional copper electrowinning occurs by the following reactions:

Cathode Reaction:

$$Cu^{2+}+SO_4^{2-}+2e^-\rightarrow Cu^0+SO_4^{2-}\ (E^0=+0.345\ V)$$

Anode Reaction:

$$H_2O\rightarrow \tfrac{1}{2}O_2+2H^++2e^-\ (E^0=-1.230\ V)$$

Overall Cell Reaction:

$$Cu^{2+}+SO_4^{2-}+H_2O\rightarrow Cu^0+2H^++SO_4^{2-}+\tfrac{1}{2}O_2\ (E^0=-0.885\ V)$$

So-called conventional copper electrowinning chemistry and electrowinning apparatus are known in the art. Conventional electrowinning operations typically operate at current densities in the range of about 220 to about 400 Amps per square meter of active cathode (20-35 A/ft$^2$), and most typically between about 300 and about 350 A/m$^2$ (28-32 A/ft$^2$). Using additional electrolyte circulation and/or air injection into the cell allows higher current densities to be achieved (e.g., 400-500 A/m$^2$).

In accordance with one aspect of an embodiment of the invention, an electrowinning apparatus comprises multiple electrowinning cells configured in series or otherwise electrically connected, each comprising a series of electrodes alternating anodes and cathodes. In accordance with one aspect of an exemplary embodiment, each electrowinning cell or portion of an electrowinning cell comprises between about 4 and about 80 anodes and between about 4 and about 80 cathodes. In accordance with one aspect of another exemplary embodiment, each electrowinning cell or portion of an electrowinning cell comprises from about 15 to about 40 anodes and about 16 to about 41 cathodes. However, it should be appreciated that in accordance with the present invention, any number of anodes and/or cathodes may be utilized.

Each electrowinning cell or portions of each electrowinning cell may preferably be configured with a base portion having a collecting configuration, such as, for example, a conical-shaped or trench-shaped base portion, which collects the copper powder product harvested from the cathodes for removal from the electrowinning cell. For purposes of this detailed description of preferred embodiments of the invention, the term "cathode" refers to a complete positive electrode assembly (typically connected to a single bar). For example, in a cathode assembly comprising multiple thin rods suspended from a bar, the term "cathode" is used to refer to the group of thin rods, and not to a single rod.

With further reference to FIG. 1, in operation of the electrowinning apparatus, a copper-containing solution 101 enters the electrowinning apparatus, preferably from one end, and flows through the apparatus (and thus past the electrodes), during which copper is electrowon from the solution to form copper powder. A copper powder slurry stream 102, which comprises the copper powder product and electrolyte collects in the base portion of the apparatus and is thereafter removed, while a lean electrolyte stream 108 exits the apparatus from a side or top portion of the apparatus, preferably from an area generally opposite the entry point of the copper-containing solution to the apparatus. Optionally, in accordance with one exemplary embodiment of the invention, the lean electrolyte exiting the electrowinning apparatus may be subjected to filtration to remove suspended copper particles before being recycled to the electrowinning apparatus, utilized in other processing areas, or disposed of. Moreover, the rich electrolyte entering the electrowinning apparatus may be subjected to filtration prior to electrowinning to remove any undesirable solid and/or liquid impurities (including organic liquid impurities). When utilized, the degree of filtration desired generally will be determined by the purity needs of the final copper powder product (in the case of filtration prior to electrowinning), the needs of other processing operations, and/or the amount of solid and/or liquid impurities present in the stream(s).

Anode Characteristics

In accordance with one exemplary embodiment of the present invention, a flow-through anode is incorporated into the cell. As used herein, the term "flow-through anode" refers to any anode configured to enable electrolyte to pass through it. While fluid flow from an electrolyte flow manifold provides electrolyte movement, a flow-through anode allows the electrolyte in the electrochemical cell to flow through the anode during the electrowinning process. Any now known or hereafter devised flow-through anode may be utilized in accordance with various aspects of the present invention. Possible configurations include, but are not limited to, metal, metal wool, metal fabric, other suitable conductive nonmetallic materials (e.g., carbon materials), an expanded porous metal structure, metal mesh, expanded metal mesh, corrugated metal mesh, multiple metal strips, multiple metal wires or rods, woven wire cloth, perforated metal sheets, and the like, or combinations thereof. Moreover, suitable anode configurations are not limited to planar configurations, but may include any suitable multiplanar geometric configuration.

Anodes employed in conventional electrowinning operations typically comprise lead or a lead alloy, such as, for example, Pb—Sn—Ca. One significant disadvantage of using such anodes is that, during the electrowinning operation, small amounts of lead are released from the surface of the anode and ultimately cause the generation of undesirable sediments, "sludges," particulates suspended in the electrolyte, other corrosion products, or other physical degradation products in the electrochemical cell and contamination of the copper product. For example, copper produced in operations employing a lead-containing anode typically comprises lead contaminant at a level of from about 0.5 ppm to about 15 ppm. In accordance with one aspect of a preferred embodiment of the present invention, the anode is substantially lead-free. Thus, generation of lead-containing sediments, "sludges," particulates suspended in the electrolyte, or other corrosion or physical degradation products and resultant contamination of the copper powder with lead from the anode is avoided. In conventional electrowinning processes using such lead anodes, another disadvantage is the need for cobalt to control the surface corrosion characteristics of the anode, to control the formation of lead oxide, and/or to prevent the deleterious effects of manganese in the system.

In accordance with one aspect of an exemplary embodiment of the invention, the anode is formed of one of the so-called "valve" metals, including titanium (Ti), tantalum (Ta), zirconium (Zr), or niobium (Nb). The anode may also be formed of other metals, such as nickel (Ni), or a metal alloy (e.g., a nickel-chrome alloy), intermetallic mixture, or a ceramic or cermet containing one or more valve metals. For example, titanium may be alloyed with nickel, cobalt (Co), iron (Fe), manganese (Mn), or copper (Cu) to form a suitable anode. In another example, titanium may be clad upon copper or aluminum to form a suitable anode. Preferably, in accordance with one exemplary embodiment, the anode comprises titanium, because, among other things, titanium is rugged and corrosion-resistant. Titanium anodes, for example, when used in accordance with various embodiments of the present invention, potentially have useful lives of up to fifteen years or more.

The anode may also optionally comprise any electrochemically active coating. Exemplary coatings include those provided from platinum, ruthenium, iridium, or other Group VIII metals, Group VIII metal oxides, or compounds comprising Group VIII metals, and oxides and compounds of titanium, molybdenum, tantalum, and/or mixtures and combinations thereof. Ruthenium oxide and iridium oxide are two preferred compounds for use as an electrochemically active coating on titanium anodes.

In accordance with another aspect of an exemplary embodiment of the invention, the anode comprises a titanium mesh (or other metal, metal alloy, intermetallic mixture, or ceramic or cermet as set forth above) upon which a coating comprising carbon, graphite, a mixture of carbon and graphite, a precious metal oxide, or a spinel-type coating is applied. Preferably, in accordance with one exemplary embodiment, the anode comprises a titanium mesh with a coating comprised of a mixture of carbon black powder and graphite powder.

In accordance with an exemplary embodiment of the invention, the anode comprises a carbon composite or a metal-graphite sintered material. In accordance with other embodiments of the invention, the anode may be formed of a carbon composite material, graphite rods, graphite-carbon coated metallic mesh and the like. Moreover, a metal in the metallic mesh or metal-graphite sintered exemplary embodiment is described herein and shown by example using titanium; however, any metal may be used without detracting from the scope of the present invention.

In accordance with one exemplary embodiment, a wire mesh may be welded to the conductor rods, wherein the wire mesh and conductor rods may comprise materials as described above for anodes. In one exemplary embodiment, the wire mesh comprises of a woven wire screen with 80 by 80 strands per square inch, however various mesh configurations may be used, such as, for example, 30 by 30 strands per square inch. Moreover, various regular and irregular geometric mesh configurations may be used. In accordance with yet another exemplary embodiment, a flow-through anode may comprise a plurality of vertically-suspended metal or metal alloy rods, or metal or metal alloy rods fitted with graphite tubes or rings. In accordance with another aspect of an exemplary embodiment, the hanger bar to which the anode body is attached comprises copper or a suitably conductive copper alloy, aluminum, or other suitable conductive material.

Cathode Characteristics

Conventional copper electrowinning operations use either a copper starter sheet or a stainless steel or titanium "blank" as the cathode. These conventional cathodes, however, do not permit electrolyte to flow through, and are thus not suitable for the production of copper powder in connection with the various aspects of the present invention. In accordance with one aspect of an exemplary embodiment of the invention, the cathode in the electrowinning apparatus is configured to allow flow of electrolyte through the cathode. In accordance with one exemplary embodiment of the present invention, a flow-through cathode is incorporated into the electrowinning apparatus. As used herein, the term "flow-through cathode" refers to any cathode configured to enable electrolyte to pass through it. While fluid flow from an electrolyte flow manifold provides electrolyte movement, a flow-through cathode allows the electrolyte in the electrochemical cell to flow through the cathode during the electrowinning process.

Various flow-through cathode configurations may be suitable, including: (1) multiple parallel metal wires, thin rods, including hexagonal rods or other geometries, (2) multiple parallel metal strips either aligned with electrolyte flow or inclined at an angle to flow direction, (3) metal mesh, (4) expanded porous metal structure, (5) metal wool or fabric, and/or (6) conductive polymers. The cathode may be formed of copper, copper alloy, titanium, aluminum, or any other metal or combination of metals and/or other materials. The surface finish of the cathode (e.g., whether polished or unpolished) may affect the harvestability of the copper powder. Polishing or other surface finishes, surface coatings, surface oxidation layer(s), or any other suitable barrier layer may advantageously be employed to enhance harvestability. Alternatively, unpolished surfaces may also be utilized.

In accordance with various embodiments of the present invention, the cathode may be configured in any manner now known or hereafter devised by the skilled artisan.

All or substantially all of the total surface area of the portion of the cathode that is immersed in the electrolyte during operation of the electrochemical cell is referred to herein, and generally in the literature, as the "active" surface area of the cathode. This is the portion of the cathode onto which copper powder is formed during electrowinning. In accordance with an exemplary embodiment of the invention, the anodes and cathodes in the electrowinning cell are spaced evenly across the cell, and are maintained at as close an interelectrode spacing as possible to optimize power consumption and mass transfer while minimizing electrical short-circuiting of current between the electrodes. While anode/cathode spacing in conventional electrowinning cells is typically about 2 inches or greater from anode to cathode, electrowinning cells configured in accordance with various aspects of the present invention preferably exhibit anode/cathode spacing of from about 0.5 inch to about 4 inches, and preferably less than about 2 inches. More preferably, electrowinning cells configured in accordance with various aspects of the present invention exhibit anode/cathode spacing of about or less than about 1.5 inches. As used herein, "anode/cathode spacing" is measured from the centerline of an anode hanger bar to the centerline of the adjacent cathode hanger bar.

In accordance with one aspect of an exemplary embodiment of the present invention, when one or more flow-through cathodes are utilized in combination with one or more flow-through anodes within the electrowinning cell, significant enhancements to mass transport of ionic species to and from the surfaces of the anodes and cathodes can be achieved.

Electrolyte Flow Characteristics

Generally speaking, any electrolyte pumping, circulation, or agitation system capable of maintaining satisfactory flow and circulation of electrolyte between the electrodes in an electrochemical cell such that the process specifications described herein are practical may be used in accordance with various embodiments of the invention.

In accordance with an exemplary embodiment of the invention, the electrolyte flow rate is maintained at a level of from about 0.05 gallons per minute per square foot of active cathode to about 30 gallons per minute per square foot of active cathode. Preferably, the electrolyte flow rate is maintained at a level of from about 0.1 gallons per minute per square foot of active cathode to about 0.75 gallons per minute per square foot of active cathode, and preferably at a level of from about 0.2 to about 0.3 gallons per minute per square foot of active cathode. It should be recognized that the optimal operable electrolyte flow rate useful in accordance with the present invention will depend upon the specific configuration of the process apparatus, and thus flow rates in excess of about 30 gallons per minute per square foot of active cathode or less than about 0.05 gallons per minute per square foot of active cathode may be optimal in accordance with various embodiments of the present invention. Moreover, electrolyte movement within the cell may be augmented by agitation, such as through the use of mechanical agitation and/or gas/solution injection devices, to enhance mass transfer.

Cell Voltage

In accordance with an exemplary embodiment of the invention, overall cell voltage of from about 1.5 to about 3.0 V is achieved, preferably from about 1.6 to about 2.5 V, and more preferably from about 1.7 to about 2.0 V. The mechanism for optimizing cell voltage within the electrowinning cell will vary in accordance with various exemplary aspects and embodiments of the present invention. Moreover, the overall cell voltage achievable is dependent upon a number of other interrelated factors, including electrode spacing, the configuration and materials of construction of the electrodes, acid concentration and copper concentration in the electrolyte, current density, electrolyte temperature, and, to a smaller extent, the nature and amount of any additives to the electrowinning process (such as, for example, flocculants, surfactants, and the like).

In addition, the present inventors have recognized that independent control of anode and cathode current densities, together with managing voltage overpotentials, can be utilized to enable effective control of overall cell voltage and current efficiency. For example, the configuration of the electrowinning cell hardware, including, but not limited to, the ratio of cathode surface area to anode surface area, can be modified in accordance with the present invention to optimize cell operating conditions, current efficiency, and overall cell efficiency.

Current Density

The operating current density of the electrowinning cell affects the morphology of the copper powder product and directly affects the production rate of copper powder within the cell. In general, higher current density decreases the bulk density and particle size of the copper powder and increases surface area of the copper powder, while lower current density increases the bulk density of copper product (sometimes resulting in cathode copper if too low, which generally is undesirable). For example, the production rate of copper powder by an electrowinning cell is approximately proportional to the current applied to that cell—a cell operating at, say, 100 A/ft$^2$ of active cathode produces approximately five times as much copper powder in a given time as a cell operating at 20 A/ft$^2$ of active cathode, all other operating conditions, including active cathode area, remaining constant. The current-carrying capacity of the cell furniture is, however, one limiting factor. Also, when operating an electrowinning cell at a high current density, the electrolyte flow rate through the cell may need to be adjusted so as not to deplete the available copper in the electrolyte for electrowinning. Moreover, a cell operating at a high current density may have a higher power demand than a cell operating at a low current density, and as such, economics also plays a role in the choice of operating parameters and optimization of a particular process.

In accordance with an exemplary embodiment of the invention, the operating current density of the electrowinning apparatus ranges from about 10 to about 200 A/ft$^2$ of active cathode, and preferably is on the order of from about 90 to about 100 A/ft$^2$ of active cathode. The mechanism for optimizing operating current density within the electrowinning cell will vary in accordance with various exemplary aspects and embodiments of the present invention.

Temperature

In accordance with one aspect of an exemplary embodiment of the present invention, the temperature of the electrolyte in the electrowinning cell is maintained at from about 40° F. to about 150° F. In accordance with one preferred embodiment, the electrolyte is maintained at a temperature of from about 90° F. to about 140° F. Higher temperatures may, however, be advantageously employed. For example, in direct electrowinning operations, temperatures higher than 140° F. may be utilized. Alternatively, in certain applications, lower temperatures may advantageously be employed. For example, when direct electrowinning of dilute copper-containing solutions is desired, temperatures below 85° F. may be utilized.

The operating temperature of the electrolyte in the electrowinning cell may be controlled through any one or more of a variety of means well known in the art, including, for example, heat exchange, an immersion heating element, an in-line heating device (e.g., a heat exchanger), or the like, preferably coupled with one or more feedback temperature control means for efficient process control.

Acid Concentration

In accordance with an exemplary embodiment of the present invention, the acid concentration in the electrolyte for electrowinning may be maintained at a level of from about 5 to about 250 grams of acid per liter of electrolyte. In accordance with one aspect of a preferred embodiment of the present invention, the acid concentration in the electrolyte is advantageously maintained at a level of from about 150 to about 205 grams of acid per liter of electrolyte, and preferably on the order of about 190 grams of acid per liter of electrolyte, depending upon the upstream process.

Copper Concentration

In accordance with an exemplary embodiment of the present invention, the copper concentration in the electrolyte for electrowinning is advantageously maintained at a level of from about 5 to about 40 grams of copper per liter of electrolyte. In accordance with one exemplary embodiment, the copper concentration is maintained at a level of from about 10 g/L to about 30 g/L, and preferably, the copper concentration is maintained at a level of about 15 g/L. However, various aspects of the present invention may be beneficially applied to processes employing copper concentrations above and/or below these levels, with lower copper concentration levels of from about 0.5 to about 5 g/L and upper copper concentration levels of from about 40 g/L to about 50 g/L being applied in some cases.

Iron Concentration

In accordance with an exemplary embodiment of the present invention, the total iron concentration in the electrolyte is maintained at a level of from about 0.01 to about 3.0 grams of iron per liter of electrolyte. It is noted, however, that the total iron concentration in the electrolyte may vary in accordance with various embodiments of the invention, as total iron concentration is a function of iron solubility in the electrolyte. Iron solubility in the electrolyte varies with other process parameters, such as, for example, acid concentration, copper concentration, and temperature. In accordance with one aspect of an exemplary embodiment of the invention, the iron concentration in the electrolyte is maintained at as low a level as possible, maintaining just enough iron in the electrolyte to counteract the effects of manganese in the electrolyte, which has a tendency to "coat" the surfaces of the electrodes and detrimentally affect cell voltage.

Harvest of Copper Powder

While in situ harvesting configurations may be desirable to minimize movement of cathodes and to facilitate the removal of copper powder on a continuous basis, any number of mechanisms may be utilized to harvest the copper powder product from the cathode in accordance with various aspects of the present invention. Any device now known or hereafter devised that functions to facilitate the release of copper powder from the surface of the cathode to the base portion of the electrowinning apparatus, enabling collection and further processing of the copper powder in accordance with other aspects of the present invention, may be used. The optimal harvesting mechanism for a particular embodiment of the present invention will depend largely on a number of interrelated factors, primarily current density, copper concentration in the electrolyte, electrolyte flow rate, and electrolyte temperature. Other contributing factors include the level of mixing within the electrowinning apparatus, the frequency and duration of the harvesting method, and the presence and amount of any process additives (such as, for example, flocculent, surfactants, and the like).

In situ harvesting configurations, either by self-harvesting (described below) or by other in situ devices, may be desirable to minimize the need to remove and handle cathodes to facilitate the removal of copper powder from the electrowinning cell. Moreover, in situ harvesting configurations may advantageously permit the use of fixed electrode cell designs. As such, any number of mechanisms and configurations may be utilized.

Examples of possible harvesting mechanisms include vibration (e.g., one or more vibration and/or impact devices affixed to one or more cathodes to displace copper powder from the cathode surface at predetermined time intervals), a pulse flow system (e.g., electrolyte flow rate increased dramatically for a short time to displace copper powder from the cathode surface), use of a pulsed power supply to the cell, use of ultrasonic waves, and use of other mechanical displacement means to remove copper powder from the cathode surface, such as intermittent or continuous air bubbles. Alternatively, under some conditions, "self-harvest" or "dynamic harvest" may be achievable, when the electrolyte flow rate is sufficient to displace copper powder from the cathode surface as it is formed, or shortly after deposition and crystal growth occurs.

In accordance with an aspect of one embodiment of the invention, fine copper powder that is carried through the cell with the electrolyte is removed via a suitable filtration, sedimentation, or other fines removal/recovery system.

Referring again to FIG. 1, in accordance with one aspect of an exemplary embodiment of the invention, copper powder slurry stream 102 from electrowinning stage 1010 optionally is subjected to solid/liquid separation (step 1020) to reduce the amount of electrolyte in stream 102. Optional solid/liquid separation stage 1020 may comprise any apparatus now known or hereafter developed for separating at least a portion of the electrolyte (stream 104) from the copper powder in copper powder slurry stream 102, such as, for example, a clarifier, a spiral classifier, other screw-type devices, a countercurrent decantation (CCD) circuit, a thickener, a filter, a conveyor-type device, a gravity separation device, or other suitable apparatus. In accordance with one aspect of an exemplary embodiment of the invention, the solid/liquid separation apparatus chosen will enable separation of electrolyte from the copper powder while preventing exposure of the copper powder to air, which can cause rapid surface oxidation of the copper powder particles.

In accordance with an optional aspect of an exemplary embodiment of the invention, at least a portion of electrolyte stream 104 leaving solid/liquid separation stage 1020 may be recycled to the electrowinning cell (stream 112) and/or may be combined with lean electrolyte stream 108 (stream 111).

In accordance with one embodiment of the invention, copper powder slurry stream 102 from electrowinning stage 1010 has a solids content of from about 5 percent by weight to about 30 percent by weight. However, the solids content of copper powder slurry stream 102 from electrowinning stage 1010 is largely dependent upon the copper powder harvesting method chosen in electrowinning stage 1010. Preferably, solid/liquid separation stage 1020, when used, is configured to produce a concentrated copper powder slurry stream 103 that has a solids content of at least about 20, and preferably greater than about 30 percent by weight, for example, in the range of about 60 to about 80 percent by weight or more depending upon the bulk density and morphology of the copper powder. High solids content may be advantageous, particularly if coarse or granular copper powder is harvested. It is generally desirable to separate as much electrolyte as possible from the copper powder prior to subjecting the copper powder slurry stream to further processing, as doing so potentially reduces the cost of downstream processing (e.g., by reducing process stream volume and thus capital and operating expenses) and potentially increases the quality of the final copper powder product (e.g., by reducing surface oxidation of the copper powder particles by the electrolyte and by reducing levels of entrained impurities).

With continued reference to FIG. 1, in accordance with an exemplary embodiment of the invention, after leaving solid/liquid separation stage 1020, concentrated copper powder slurry stream 103 is subjected to a conditioning stage 1030 to further condition the copper powder in preparation for drying. In accordance with various aspects of an exemplary embodiment, conditioning stage 1030, comprising one or more processing steps, is configured to (i) adjust of the pH of concentrated copper powder slurry stream 103, (ii) stabilize the surface of the copper powder particles to prevent surface oxidation, and/or (iii) further reduce the amount of excess liquid in the copper powder slurry stream to form a moist copper powder product. Adjustment of the pH of concentrated copper powder slurry stream 103 and stabilization of the surface of the copper powder particles in copper powder slurry stream 103 is facilitated by the addition of one or more conditioning agents 105 to conditioning stage 1030.

In accordance with one exemplary aspect of an embodiment of the present invention, conditioning stage 1030 comprises any apparatus now known or hereafter developed capable of achieving the above objectives, and, in particular, capable of treating substantially all surfaces of the copper particles reasonably equally with conditioning agents 105. In accordance with one exemplary embodiment of the invention, conditioning stage 1030 comprises use of a centrifuge. Exemplary processing parameters for conditioning stage 1030 are discussed hereinbelow in connection with another embodiment of the present invention.

In accordance with one aspect of an exemplary embodiment of the present invention, it may be advantageous that a dewatering stage 1040 be employed to enable a bulk of the liquid in copper powder stream 106 to be separated from the bulk of the copper powder as economically as possible. For example, a centrifuge, a filter, or other suitable solid/liquid separation apparatus may be used. In accordance with one aspect of this embodiment of the invention, this separation may be accomplished during and/or in connection with conditioning the copper powder slurry in conditioning stage 1030, such as in connection with conditioning stage 1030 when use of a centrifugal conditioning step is carried out. Alternatively, in certain embodiments, additional dewatering may be desired to yield a copper powder product that is useable for future processing without additional conditioning and/or processing (e.g., drying).

With further reference to FIG. 1, after leaving optional dewatering stage 1040, copper powder stream 107 may be subjected to an optional drying stage 1050 to produce a final copper powder product stream 110. In accordance with an exemplary aspect of an embodiment of the present invention, drying stage 1050 comprises any apparatus now known or hereafter developed capable of drying the copper powder sufficiently for packaging as a final product and/or for transfer to downstream process and for downstream processing steps for formation of alternative copper products. For example, drying stage 1050 may comprise a flash dryer, a cyclone, a dry sintering apparatus, a conveyor belt dryer, and/or other suitable apparatus. Furthermore, in cases where the copper powder is to be melted (e.g., rod mill, shaft furnace, etc.), then the excess heat from the melting process may be used beneficially to dry the copper powder product.

In accordance with another exemplary embodiment of the invention, a process for producing copper powder includes the steps of (i) electrowinning copper powder from a copper-containing solution to produce a slurry stream containing copper powder particles and electrolyte; (ii) optionally, separating at least a portion of the electrolyte from the copper powder particles in the slurry stream; (iii) optionally, separating one or more coarse copper powder particle size distributions in the slurry stream from one or more finer copper powder particle size distributions in the slurry stream in one or more size classification stages; (iv) conditioning the slurry stream; (v) optionally, separating at least a portion of the bulk of the liquid from the copper powder particles; (vi) optionally, drying the copper powder particles in the slurry stream to produce a dry copper powder stream; (vii) optionally, separating one or more coarse copper powder particle size distributions in the dry copper powder stream from one or more finer copper powder particle size distributions in the dry copper powder stream in one or more size classification stages; and (viii) either collecting the copper powder final product from the process or subjecting the copper powder stream to further processing. (e.g., briquetting, extrusion, melting or other downstream process).

Turning now to FIG. 2, copper powder process 200 exemplifies various aspects of another embodiment of the present invention. In accordance with the illustrated embodiment, a copper-containing solution 201 is provided to an electrowinning stage 2010. Electrowinning stage 2010 is configured to produce a copper powder slurry stream 203, which comprises copper powder and an electrolyte, and a lean electrolyte stream 202. Lean electrolyte stream 202 may be recycled to upstream processing operations (such as, for example, an upstream leaching operation used to produce copper-containing solution 201), used in other processing operations, or impounded or disposed of. In cases where the copper product is to be melted, for example, in a rod mill or shaft furnace, then the excess heat from the melting process may be used beneficially to dry the said copper product.

In accordance with one aspect of an exemplary embodiment of the invention, copper powder slurry stream 203 then optionally undergoes solid/liquid separation in solid/liquid separation (or "dewatering") stage 2020, which may, as described above in connection with FIG. 1, comprise any apparatus now known or hereafter developed for separating at least a portion of the bulk electrolyte (stream 204) from the copper powder in copper powder slurry stream 203, such as, for example, a clarifier, a spiral classifier, a screw-type device, a countercurrent decantation (CCD) circuit, a thickener, a filter, a gravitational separator device, a conveyor-type device, or other suitable apparatus. Such an advantageous bulk liquid removal step may yield a copper powder product that is useable for future processing without additional conditioning and/or processing. Preferably, semi-continuous copper powder harvesting within the electrowinning cell is advantageously matched with batch downstream processing (i.e., dewatering and conditioning) such that copper powder product is more continuously recovered. For example, multiple solid/liquid separation devices may be employed in connection with a conditioning stage, and as such, downstream solid/liquid separation may be eliminated.

With further reference to FIG. 2, in accordance with an optional aspect of an embodiment of the present invention, the resulting concentrated copper powder slurry from optional solid/liquid separation stage 2020 (stream 205) may be collected in a copper powder slurry tank 2030. Copper powder slurry tank 2030 is configured to hold the concentrated copper slurry and to maintain homogeneity of the slurry through mixing, agitation, or other means. Additionally, process water 215 and/or a pH-adjusting agent 216 (such as, for example, ammonium hydroxide) may optionally be added to copper powder slurry tank to aid in maintaining homogeneity of the slurry, stabilizing the copper powder in the slurry, and/or adjusting the pH of the slurry in preparation for further processing. In accordance with another aspect of an exemplary embodiment of the invention, slurry tank 2030 is configured such that the copper powder slurry is not exposed to air during storage and/or treatment, as such exposure may, as described above, detrimentally affect the surface integrity of the copper powder particles.

Upon discharge from slurry tank 2030, slurry stream 206 may, optionally, undergo a size classification stage 2040. If utilized, the objective of size classification stage 2040 is to separate coarser copper powder particles from finer copper powder particles in the slurry stream, in accordance with specifications for the desired final copper powder product. For example, if the final copper powder product is to be used for extruding copper shapes or other products, such as by direct rotary extrusion, a slurry stream comprising finer copper powder particles is preferred, whereas if the final copper powder product is to be melted for rod or other product formation, relatively coarse copper powder particles may be preferable. As used herein, the term "coarse" describes copper powder particles larger than about 150 microns (in the range of about plus 100 mesh). The term "fine" is used herein to describe copper powder particles smaller than about 45 microns (in the range of about minus 325 mesh). Particles between those ranges are referred to as "intermediate" particles.

When size classification is desired, it may be carried out at any suitable stage in the copper powder production process, the suitability of any stage being dependent upon a variety of factors, including the size of the copper powder particles leaving the electrowinning stage, the configuration and materials of construction of the size classification apparatus, and other engineering and economic process considerations. In accordance with an exemplary embodiment of the invention, when utilized, size classification may be conducted on the slurry stream leaving the electrowinning cell, the optional slurry tank (prior to conditioning), and/or on the copper powder product stream. Such processing may allow for stabilization of fine particles and different treatment of coarser particles. In the event size classification is conducted, the different particle size distributions, or, if desired, various mixtures thereof, may be processed further, as will now be discussed.

Referring again to FIG. 2, in accordance with an exemplary embodiment of the invention, after leaving optional size classification stage 2040, slurry stream 207 (or slurry stream 206, if size classification is not utilized) is subjected to an optional conditioning operation 2050 to condition the copper powder and/or the solution in preparation for dewatering and optional drying. In accordance with one exemplary aspect of an embodiment of the present invention, conditioning operation 2050, when used, may be performed in conjunction with a dewatering operation 2060.

In accordance with one embodiment of the present invention, optional conditioning operation 2050 may include washing, pH adjustment, removal of impurities, stabilization, and/or other conditioning operations.

In accordance with an exemplary embodiment of the invention, the copper slurry may be contacted with a washing agent 208 and/or a stabilizing agent 209. Washing agent 208 can comprise any liquid material, water, ammonium hydroxide, and/or mixtures thereof. Optionally, washing agent 208 may include additional materials, such as, for example, surfactants, soaps, and the like. In accordance with one aspect of an exemplary embodiment of the invention, washing agent 208 may be heated prior to washing, which may enhance impurity removal. Stabilizing agent 209 may be any agent suitable for preventing surface oxidation of the copper powder particles (which oxidation may diminish the value and/or quality of the copper powder product and/or may negatively impact downstream operations or applications).

In accordance with various aspects of an exemplary embodiment, stabilizing agent 209 comprises an organic surfactant in combination with a stabilizer. The organic surfactant may be used to lower the surface tension of the stabilizer and thus enable the stabilizer to coat all facets of the copper powder particles. The stabilizer, on the other hand, preferably is the "active" agent that coats the particles and prevents oxidation, thus providing a suitable shelf life to the copper powder product and enabling transfer of the copper powder in an otherwise oxidizing atmosphere (i.e., air). Some suitable stabilizers include, for example, 1,2,3-Benzotriazole (BTA), animal glue, fish glue, soaps, and the like. Under certain circumstances, however, the use of a stabilization agent may be unnecessary, such as when the copper powder product is intended to be processed immediately after production (by melting and casting, for example) or when an oxidized copper product is desired. Moreover, other methods of preventing surface oxidation of the copper powder particles during processing may reduce or eliminate the need for a stabilization agent, such as, for example, use of a charged fluidized bed or use of nitrogen blanketing during one or more stages of copper powder handling. If it is desirable to store the copper powder product for an extended period of time, however, then a stabilizing agent may be desired.

In accordance with an exemplary aspect of an embodiment of the present invention, it is advantageous that a dewatering stage 2060 be employed to enable a bulk of the liquid in copper powder stream 211 to be separated from the bulk of the copper powder as economically as possible. For example, a centrifuge, a filter, or other suitable solid/liquid separation apparatus may be used.

In accordance with one aspect of this embodiment of the invention, this separation may be accomplished during or in connection with conditioning the copper powder slurry, such as in connection with optional conditioning operation 2050. Such an advantageous dewatering step may yield a copper powder product that is useable for future processing without additional conditioning and/or processing (e.g., drying). In accordance with an exemplary embodiment, after the copper powder is washed and stabilized, a dewatering stage 2060 is utilized to draw as much liquid from copper powder slurry 211 as possible, producing a moist copper powder stream 212. Moist copper powder stream 212 may then be subjected to an optional drying stage 2070 to produce a final copper powder product stream 213.

In accordance with an exemplary aspect of an embodiment of the present invention, optional drying stage 2070 comprises any apparatus now known or hereafter developed capable of drying the copper powder sufficiently for packaging as a final product and/or for shipping to downstream process and for downstream processing steps for formation of alternative copper products. For example, drying stage 2070 may comprise a flash dryer, a fluid bed dryer, a rotary dryer, a cyclone, a dry sintering apparatus, a conveyor belt dryer, and/or other suitable apparatus for direct or indirect drying. In accordance with an exemplary embodiment, optional drying stage 2070 comprises a flash dryer that enables rapid drying of the copper powder particles without disturbing the integrity of the stabilizer coating on the copper powder particles. In drying stage 2070, moist copper powder stream 212 is contacted with sufficient hot air for a period of time sufficient to reduce the moisture content of the copper powder particles. The final moisture content of the copper powder product stream 213 may vary, depending upon the nature of any downstream processing of the copper powder (through, for example, size classification, packaging, direct forming of copper shapes and rods, casting, briquetting, and the like). In this regard, in certain applications, significant moisture content may be retained without deleteriously impacting subsequent processing.

As mentioned above, and with further reference to FIG. 2, after leaving optional drying stage 2070, copper powder product stream 213 may optionally undergo size classification in size classification stage 2080 to achieve a desired particle size distribution in the final copper powder product 214. The final copper powder product 214 may then be sent to a packaging operation 2090—for example, a bagging operation—or may be subjected to further processing 2095 to change the character of the final copper product.

The present invention has been described above with reference to a number of exemplary embodiments. It should be appreciated that the particular embodiments shown and described herein are illustrative of the invention and its best mode and are not intended to limit in any way the scope of the invention. Those skilled in the art having read this disclosure will recognize that changes and modifications may be made to the exemplary embodiments without departing from the scope of the present invention. For example, various aspects and embodiments of this invention may be applied to electrowinning of metals other than copper, such as nickel, zinc, cobalt, and others. Although certain preferred aspects of the invention are described herein in terms of exemplary embodiments, such aspects of the invention may be achieved through any number of suitable means now known or hereafter devised. Accordingly, these and other changes or modifications are intended to be included within the scope of the present invention.

What is claimed is:

1. A process for producing copper powder by electrowinning comprising the steps of:

introducing a copper-containing solution into a flow-through electrowinning cell; and electrowinning copper powder from said copper-containing solution to produce a slurry stream containing copper powder particles and electrolyte, wherein said step of electrowinning copper powder comprises producing oxygen gas at an anode and forming copper powder at a cathode while maintaining a current density within said electrowinning cell of from about 10 to about 200 amperes per square foot of active cathode.

2. The process of claim 1, further comprising the step of conditioning at least a portion of said slurry stream to remove contaminants and/or impurities contained in the residual entrained electrolyte.

3. The process of claim 1, further comprising the step of drying the copper powder particles originally present in the slurry stream to produce a copper powder product.

4. The process of claim 1, further comprising the step of subjecting said copper powder product to at least one of size classification, packaging, direct forming, casting, briquetting, extrusion or melting.

5. The process of claim 1, further comprising the step of separating at least a portion of the coarse copper powder particles in said slurry stream from at least a portion of the fine copper powder particles in said slurry stream in a size classification stage.

6. The process of claim 1, further comprising the steps of:

washing at least a portion of the copper powder particles in said slurry stream to produce a waste solution stream; and separating at least a portion of said waste solution stream from said copper powder particles.

7. The process of claim 1, further comprising harvesting said copper powder particles.

8. The process of claim 7, wherein said harvesting further comprises at least one of vibration, pulse electrolyte flow, pulsed power supply, ultrasonic waves, intermittent air bubbles and continuous air bubbles.

9. The process of claim 7, wherein said harvesting further comprises using gravitational separation.

10. The process of claim 9, further comprising collecting said copper powder particles with a conical base portion.

11. The process of claim 1, further comprising in situ harvesting said copper powder particles.

12. A process for producing copper powder by electrowinning, comprising the steps of:

introducing a copper-containing solution into a flow-through electrowinning cell; and electrowinning copper powder from said copper-containing solution to produce a slurry stream containing copper powder particles and electrolyte, wherein said step of electrowinning copper powder comprises producing oxygen gas at an anode and forming copper powder at a cathode while maintaining a cell voltage within said electrowinning cell of from about 1.5 Volts to about 3.0 Volts and a current density within said electrowinning cell of from about 10 to about 200 amperes per square foot of active cathode.

13. The process of claim 12, further comprising the step of harvesting said copper powder particles.

14. The process of claim 13, wherein said harvesting further comprises at least one of vibration, pulse electrolyte flow, pulsed power supply, ultrasonic waves, intermittent air bubbles and continuous air bubbles.

15. The process of claim 13, wherein said harvesting further comprises using gravitational separation.

16. The process of claim 15, further comprising the step of collecting said copper powder particles with a conical base portion.

17. The process of claim 12, further comprising the step of in situ harvesting said copper powder particles.

18. A process for producing copper powder by electrowinning consisting essentially of:

introducing a copper-containing solution into a flow-through electrowinning cell;

electrowinning copper powder from a copper-containing solution to produce a slurry stream containing copper powder particles and electrolyte, wherein said step of electrowinning copper powder comprises producing oxygen gas at an anode and forming copper powder at a cathode while maintaining a current density within said electrowinning cell of from about 10 to about 200 amperes per square foot of active cathode;

optionally, separating at least a portion of the electrolyte from the copper powder particles in the slurry stream;

optionally, separating at least a portion of the coarse copper powder particles in said slurry stream from at least a portion of the fine copper powder particles in said slurry stream in a size classification stage;

conditioning at least a portion of said slurry stream;

optionally, separating at least a portion of the bulk liquid from the copper powder particles in said slurry stream;

optionally, drying at least a portion of the copper powder particles originally present in the slurry stream to produce a copper powder product; and optionally, subjecting said copper powder product to at least one of size classification, packaging, direct forming, casting, briquetting, extrusion or melting.

* * * * *